United States Patent [19]

Brown et al.

[11] 3,960,319

[45] June 1, 1976

[54] CENTRIFUGAL SEPARATOR

[75] Inventors: Francis B. Brown, La Crescenta; John W. Erickson, Huntington Beach, both of Calif.

[73] Assignee: Kobe Inc., Huntington Park, Calif.

[22] Filed: Oct. 21, 1974

[21] Appl. No.: 516,380

[52] U.S. Cl. ..... 233/19 R; 233/21; 233/27

[51] Int. Cl.[2] ..... B04B 1/12; B04B 7/04; B04B 11/02

[58] Field of Search ..... 233/DIG. 1, 1 D, 14 R, 233/14 A, 15, 17, 19 R, 19 A, 27, 28, 21

[56] References Cited

UNITED STATES PATENTS

| | | | |
|---|---|---|---|
| 2,185,279 | 1/1940 | Strezynski | 233/17 |
| 2,905,380 | 9/1959 | Matthews | 233/27 |
| 3,817,446 | 6/1974 | Erickson et al. | 233/17 |

FOREIGN PATENTS OR APPLICATIONS

| | | | |
|---|---|---|---|
| 858,820 | 12/1952 | Germany | 233/14 R |

*Primary Examiner*—George H. Krizmanich
*Attorney, Agent, or Firm*—Christie, Parker & Hale

[57] ABSTRACT

A three-phase centrifugal separator for a mixture which may include oil, water, gas and/or solids. A rotor is provided with an inner rotor chamber encircled by an outer rotor chamber, the mixture being delivered to the inner rotor chamber wherein it is centrifugally separated into an inner gas phase encircling the rotor axis, an annular intermediate oil phase encircling the gas phase, and an annular outer water and solids phase encircling the oil phase. Water and solids are discharged into the outer rotor chamber through discharge ports in the periphery of the inner rotor chamber, and are subsequently discharged into an enclosing housing means through discharge ports in the periphery of the outer rotor chamber. A water supply means delivers water to the outer rotor chamber at a rate at least equal to, and preferably considerably in excess of, the discharge capacity of the discharge ports in the outer rotor chamber at a given rotor speed so as to maintain a substantially constant pressure in the outer rotor chamber at such rotor speed. Means are provided for removing oil and gas from the corresponding phases in the inner rotor chamber.

16 Claims, 1 Drawing Figure

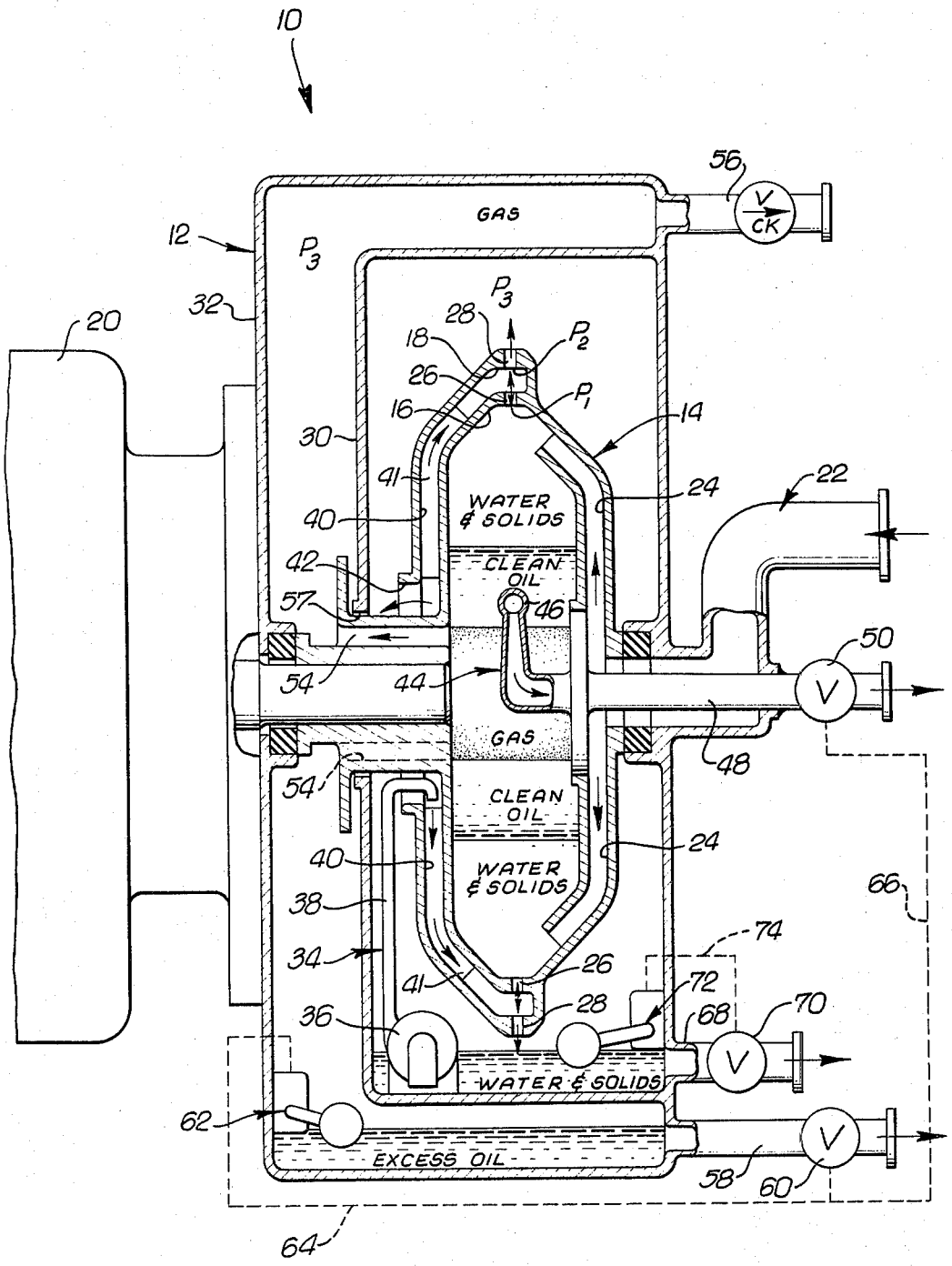
10
12
20
32
56
V
CK
GAS
$P_3$
$P_3$
28
18
$P_2$
26
$P_1$
16
14
30
41
24
22
WATER & SOLIDS
40
CLEAN OIL
42
57
46
50
54
44
V
GAS
48
54
CLEAN OIL
24
40
WATER & SOLIDS
66
38
74
34
26
41
72
28
70
36
68
V
WATER & SOLIDS
62
V
EXCESS OIL
58
60
64

CENTRIFUGAL SEPARATOR

BACKGROUND OF INVENTION

The present invention relates in general to a three-phase centrifugal separator for a mixture which may include such things as oil, water, gas and/or solids. The separator includes a rotor into which the mixture is delivered and which establishes an inner, axial gas phase, an intermediate annular oil phase encircling the gas phase, and an annular outer water and solids phase which encircles the oil phase, gas, oil, and water and solids being drawn off from the respective phases.

Prior art known to us consists of the following U.S. patents.

| Pat. No. | Patentee | Issue Date |
|---|---|---|
| 499,346 | Peck | June 13, 1893 |
| 958,770 | Richardson | May 24, 1910 |
| 1,158,959 | Beach | Nov. 2, 1915 |
| 2,067,273 | Knowles et al | Jan. 12, 1937 |
| 2,534,210 | Schutte et al | Dec. 12, 1950 |
| 3,081,027 | Coulson | March 12, 1963 |
| 3,202,347 | Thurman | Aug. 24, 1965 |
| 3,204,868 | Honeychurch | Sept. 7, 1965 |
| 3,396,910 | Steinacker | Aug. 13, 1968 |
| 3,410,481 | Dahlberg et al | Nov. 12, 1968 |
| 3,445,061 | Nilson | May 20, 1969 |
| 3,752,389 | Nilsson | Aug. 14, 1973 |

OBJECTS AND SUMMARY OF INVENTION

A general and important object of the invention is to provide a three-phase centrifugal separator having means for accurately controlling the radial positions of the water-oil and oil-gas interfaces so that oil can be drawn off from the oil phase without drawing off therewith any significant amount of water and/or gas, or any significant amount of solids which may be in the water phase.

More particularly, the invention may be summarized as comprising, and a primary object is to provide a threephase centrifugal separator which includes: housing means; a rotor rotatable in the housing means and having an inner rotor chamber and an outer rotor chamber encircling the inner rotor chamber; mixture delivery means for delivering the mixture to the inner rotor chamber; the periphery of the inner rotor chamber having discharge ports communicating with the outer rotor chamber; the periphery of the outer rotor chamber having discharge ports communicating with the housing means; water supply means for delivering water to the outer rotor chamber at a rate at least equal to the discharge capacity of the discharge ports in the outer rotor chamber at a given rotor speed so as to maintain a substantially constant pressure in the outer rotor chamber at the given rotor speed; and oil discharge means for removing oil from the inner rotor chamber. A related object of considerable importance is to provide excess-water discharge means on the rotor for discharging any excess water delivered to the outer rotor chamber into the housing means.

With the foregoing construction, the pressure in the outer rotor chamber is maintained constant for a given rotor speed. On the other hand, the pressure in the inner rotor chamber adjacent its periphery is variable, depending upon the relative quantities of water, oil, gas, solids, and the like, in the inner rotor chamber. Thus, water can flow in or out of the inner rotor chamber through the discharge ports connecting it to the outer rotor chamber, depending upon the relative values of the pressures in the inner and outer rotor chambers. This provides a very simple and effective way of controlling the radial positions of the water-oil and oil-gas interfaces. By establishing proper equilibrium conditions, the water-oil interface never moves radially inwardly as far as the oil discharge means, nor does the oil-gas interface ever move radially outwardly as far as the oil discharge means. Thus, the latter draws off only substantially clean oil, which is an important feature.

Another object of the invention is to provide a housing means which includes inner and outer housings, the discharge ports in the outer rotor chamber and the excesswater discharge means communicating with the inner housing, a gas discharge means interconnecting the inner rotor chamber and the outer housing, and an excess-oil outlet means also interconnecting the inner rotor chamber and the outer housing. With this construction, excess water, and native water in the mixture, find their way to the bottom of the inner housing, while excess oil finds its way to the bottom of the outer housing, gas being drawn off from the top of the outer housing.

Yet another object of the invention is to provide a construction wherein the water supply means includes a pump having its inlet in communication with the inner housing adjacent the bottom thereof.

An additional object is to provide a centrifugal separator which includes a water outlet communicating with the inner housing, a water outlet valve controlling the water outlet, and means controlling the water outlet valve for maintaining a predetermined water level in the inner housing.

A still further object is to provide an oil outlet communicating with the outer housing, first and second oil outlet valves respectively controlling oil flows through the oil discharge means and the oil outlet, and control means responsive to the oil level in the outer housing for controlling the oil outlet valves. A related object is to provide a construction wherein such control means includes means for closing the first and second oil outlet valves in that order in response to a decreasing oil level in the outer housing, and for opening the second and first oil outlet valves in that order in response to an increase in oil level in the outer housing.

An important feature of the oil discharge means is to be able to use a pitot tube of a given radius so that a high enough discharge pressure can be obtained to overcome flow line or gas pressure, or be used to charge a triplex. Such a pressure would be in the range of 30 to 160 psi.

The foregoing objects, advantages, features and results of the present invention, together with various other objects, advantages, features and results thereof which will be evident to those skilled in the centrifugal separator art in the light of this disclosure, may be achieved with the exemplary embodiment of the invention illustrated in the accompanying drawing and described in detail hereinafter.

DESCRIPTION OF DRAWING

The single figure of the drawing is a semidiagrammatic, longitudinal sectional view of a three-phase centrifugal separator which embodies the invention.

DESCRIPTION OF EXEMPLARY EMBODIMENT OF INVENTION

Referring to the drawing, designated generally therein by the numeral 10 is a three-phase centrifugal separator for a mixture which may include oil, water, gas and/or solids. The separator 10 includes a housing means 12 and a rotor 14 rotatable in the housing means and having an inner rotor chamber 16 and an outer rotor chamber 18 encircling the inner rotor chamber. The rotor 14 is driven in any suitable manner, as by an electric motor 20.

The centrifugal separator 10 includes mixture delivery means 22 for delivering the mixture to be separated to the inner rotor chamber adjacent the periphery thereof, the mixture delivery means including radial passage means 24 for the latter purpose.

The periphery of the inner rotor chamber 16 is provided with discharge ports 26 communicating with the outer rotor chamber 18. The periphery of the outer rotor chamber 18 is provided with discharge ports 28 communicating with the housing means 12. As will be discussed in more detail hereinafter, pressures $P_1$ and $P_2$ are established in the inner and outer rotor chambers 16 and 18 adjacent the peripheries thereof, i.e., adjacent the ports 26 and 28.

The housing means 12 comprises inner and outer housings 30 and 32, the inner housing being adapted to receive in the bottom thereof a body of water and solids and the outer housing being adapted to receive in the bottom thereof excess oil, as indicated by the corresponding legends in the drawing. The sources of these liquid bodies will become apparent hereinafter.

The centrifugal separator 10 includes a water supply means 34 for delivering water to the outer rotor chamber 18 at a rate at least equal to the discharge capacity of the discharge ports 28 in the outer rotor chamber, at a given rotor speed, so as to maintain a substantially constant pressure $P_2$ in the outer rotor chamber at such given rotor speed. In the construction illustrated, the water supply means comprises a suitably-driven pump 36 having its inlet in communication with the inner housing 30 adjacent the bottom thereof and having an outlet line 38 communicating with radial passage means 40 leading to the outer rotor chamber 18. Vanes 41 in the passage means 40 prevent fluid slippage. Preferably, the capacity of the pump 36 considerably exceeds the discharge capacity of the ports 28, at a given rotor speed, there being an excess water discharge means 42 on the rotor 14 for discharging any excess water delivered to the outer rotor chamber 18 into the inner housing 30, wherein it descends to the bottom of such housing. For example, the excess water discharge means 42 may simply be an annular weir.

As indicated by the legends within the inner rotor chamber 16, the mixture delivered thereinto through the mixture delivery means 22 is separated into an inner, axial gas phase, an intermediate annular clean-oil phase, and an outer annular water and solids phase. An oil discharge means 44 removes clean oil from the corresponding phase within the inner rotor chamber 16. As previously indicated the oil discharge means 44 may take various forms. In the construction shown, it includes a pitot tube 46 leading to an oil discharge line 48 having therein a first oil outlet valve 50.

Gas and excess clean oil not removed by the oil discharge means 44 escape from the inner rotor chamber 16 into the outer housing 32 through a combined weir-like gas discharge means and excess-oil outlet means 54. The gas is drawn off at the top of the outer housing 32 through a gas discharge means 56. Usually, the inner and outer housings 30 and 32 will be pressurized to the same pressure $P_3$, this being achieved by an annular gap 57. A check valve in the discharge means 56 prevents reverse gas flow if the incoming fluid contains little gas. The excess oil descends to the bottom of the outer housing 32 to form the correspondingly labeled oil body shown in the drawing.

The outer housing 32 is provided adjacent the bottom thereof with an oil outlet 58 for excess oil, the outlet 58 having therein a second oil outlet valve 60 controlling flow therethrough. A float-type control means 62 controls the excess oil level in the outer housing 32 by being connected to the first and second oil outlet valves 50 and 60, as indicated by the dotted line connections 64 and 66. The control means 60 comprises means for closing the first and second oil outlet valves 50 and 60 in that order in response to a decreasing oil level in the outer housing, and for opening the second and first oil outlet valves 60 and 50 in that order in response to an increasing oil level in the outer housing. The control means 62 maintains a predetermined oil level in the outer housing despite variations in the relative proportions of oil and water in the mixture delivered to the inner rotor chamber 16 through the mixture delivery means 22. For example, if, for a period of time, the mixture delivered to the inner rotor chamber 16 is all water, or virtually all water, both of the oil outlet valves 50 and 60 will be closed by the control means 62.

Similarly, the inner housing 30 is provided with a water outlet 68 having therein a water outlet valve 70 controlling the water outflow rate. A float-type control means 72 regulates the water outlet valve 70 in such a manner as to maintain a predetermined water level in the inner housing 30, the control means 72 being connected to the water outlet valve 70 as indicated by the dotted line connection 74.

Considering the over-all operation of the invention, with the dual-chamber rotor 14 illustrated and hereinbefore described, the pressure $P_2$ in the outer rotor chamber 18 is maintained constant, for a constant rotor speed, because of the previously-described excess-water delivery to the outer rotor chamber. On the other hand, $P_1$, the pressure in the inner rotor chamber 16 adjacent its outer periphery is variable, depending upon the relative quantities of gas, oil, water, solids, and the like, in the inner rotor chamber. Consequently, water can flow into or out of the inner rotor chamber 16 through the ports 26, depending upon the relative values of the variable pressure, $P_1$, and the constant reference pressure $P_2$. This construction provides a very simple and effective way of controlling the radial positions of the gas-oil and oil-water interfaces. Once equilibrium conditions are achieved, the water-oil interface never moves radially inwardly as far as the oil discharge means 44, nor does the oil-gas interface ever move outwardly as far as the oil discharge means. Thus, the oil discharge means 44 constantly draws off virtually clean oil only. As previously explained, the gas and any excess oil escape into the outer housing 32 through the combined gas discharge means and excess-oil outlet means 54. Water and solids from the corresponding phase in the inner rotor chamber 16, and water from the outer rotor chamber 18, escape into the inner housing 30 through the ports 26 and 28. The liquid levels in the inner and outer housings 30 and 32 are controlled in the manner hereinbefore described.

By providing a water delivery rate to the outer rotor chamber 18 which is high compared to the discharge capacity of the ports 28, both the ports 26 and the ports 28 can be quite large to handle large solid particles, which is an important feature.

The housing means includes inner and outer housings, the discharge ports in the outer rotor chamber, and an excess-water discharge means on the rotor, communicating with the inner housing, and the water supply means for the outer rotor chamber including a pump having its inlet in communication with the inner housing. The rotor is also provided with gas discharge means communicating with the outer housing, and excess-oil outlet means also communicating with the outer housing. Excess water is drawn off from the inner housing, and excess oil and gas are drawn off from the outer housing.

With the foregoing construction, the pressure in the outer rotor chamber adjacent to its discharge ports is maintained constant for a constant rotor speed. Also the pressure in the inner chamber adjacent to the discharge ports therein is equal to the pressure in the outer chamber so that no flow occurs when the oil, water, gas system is in equilibrium. If the oil-water interface tends to move outwardly, the pressure at the orifices of the inner chamber will drop and water will flow into the inner chamber until equilibrium is reached. Likewise, if the oil water interface moves inwardly water will flow out of the inner orifices until equilibrium is reached. Thus, water can flow in or out of the inner rotor chamber through the discharge ports therein, depending upon the relative values of the pressures in the inner and outer rotor chambers. This provides a very simply and effective way of controlling the radial positions of the water-oil and oil-gas interfaces. By establishing proper equilibrium conditions, the water-oil interface never moves radially inwardly as far as the oil discharge means in the inner rotor chamber.

While the invention has been disclosed as a separator for oil, water, gas and/or solids, it will be understood that it may be used for other mixtures of fluids of different densities.

Although an exemplary embodiment of the invention has been disclosed for illustrative purposes, it will be understood that various changes, modifications and substitutions may be incorporated in such embodiment without departing from the invention as hereinafter claimed.

We claim as our invention:

1. In a centrifugal separator for a mixture which may include oil, water, gas and/or solids, the combination of:

a. housing means;

b. a rotor rotatable in said housing means and having an inner rotor chamber and an outer rotor chamber encircling said inner rotor chamber;

c. mixture delivery means for delivering the mixture to said inner rotor chamber;

d. the periphery of said inner rotor chamber having discharge ports communicating with said outer rotor chamber;

e. the periphery of said outer rotor chamber having discharge ports communicating with said housing means;

f. water supply means for delivering water to said outer rotor chamber at a rate at least equal to the discharge capacity of said discharge ports in said outer rotor chamber at a given rotor speed;

g. an annular weir on the outer rotor chamber for discharging excess water from the outer rotor chamber so that the outer rotor chamber remains filled to the radius of the weir so as to maintain a substantially constant pressure in said outer rotor chamber adjacent said discharge ports at said given rotor speed; and g. oil discharge means for removing oil from said inner rotor chamber under pressure.

2. In a centrifugal separator for a mixture which may include oil, water, gas and/or solids, the combination of:

housing means;

a rotor rotatable in said housing means and having an inner rotor chamber and an outer rotor chamber encircling said inner rotor chamber;

mixture delivery means for delivering the mixture to said inner rotor chamber;

the periphery of said inner rotor chamber having discharge ports communicating with said outer rotor chamber;

the periphery of said outer rotor chamber having discharge ports communicating with said inner housing;

water supply means for delivering water to said outer rotor chamber at a rate at least equal to the discharge capacity of said discharge ports in said outer rotor chamber at a given rotor speed;

excess-water discharge means on said rotor for discharging any excess water delivered to said outer rotor chamber into said housing means so as to maintain a substantially constant pressure in said outer rotor chamber at said given rotor speed; and oil discharge means for removing oil from said inner rotor chamber under pressure.

3. A centrifugal separator as defined in claim 2 wherein:

a. said housing means includes inner and outer housings; and b. said discharge ports in said outer rotor chamber and said excess-water discharge means communicate with said inner housing.

4. A centrifugal separator as set forth in claim 3 wherein said water supply means includes a pump having its inlet in communication with said inner housing adjacent the bottom thereof.

5. In a centrifugal separator for a mixture which may include oil, water, gas and/or solids, the combination of:

housing means including inner and outer housings;

a rotor rotatable in said housing means and having an inner rotor chamber and an outer rotor chamber encircling said inner rotor chamber;

mixture delivery means for delivering the mixture to said inner rotor chamber;

the periphery of said inner rotor chamber having discharge ports communicating with said outer rotor chamber;

the periphery of said outer rotor chamber having discharge ports communicating with said inner housing;

water supply means for delivering water to said outer rotor chamber at a rate at least equal to the discharge capacity of said discharge ports in said outer rotor chamber at a given rotor speed so as to maintain a substantially constant pressure in said outer rotor chamber at said given rotor speed, said water supply means including a pump having its inlet in communication with said inner housing adjacent the bottom thereof;

excess-water discharge means on said rotor for discharging any excess water delivered to said outer rotor chamber into said inner housing;

oil discharge means for removing oil from said inner rotor chamber;

a water outlet communicating with said inner housing;

a water outlet valve controlling said water outlet; and means controlling said water outlet valve for maintaining a predetermined water level in said inner housing.

6. In a centrifugal separator for a mixture which may include oil, water, gas and/or solids, the combination of:

housing means including inner and outer housings;

a rotor rotatable in said housing means and having an inner rotor chamber and an outer rotor chamber encircling said inner rotor chamber;

mixture delivery means for delivering the mixture to said inner rotor chamber;

the periphery of said inner rotor chamber having discharge ports communicating with said outer rotor chamber;

the periphery of said outer rotor chamber having discharge ports communicating with said housing means;

water supply means for delivering water to said outer rotor chamber at a rate at least equal to the discharge capacity of said discharge ports in said outer rotor chamber at a given rotor speed so as to maintain a substantially constant pressure in said outer rotor chamber at said given rotor speed;

excess-water discharge means on said rotor for discharging any excess water delivered to said outer rotor chamber into said inner housing; and oil discharge means for removing oil from said inner rotor chamber; and wherein said inner rotor chamber is provided with:

gas discharge means communicating with said outer housing;

excess-oil outlet means also communicating with said outer housing.

7. A centrifugal separator as set forth in claim 6 including:

a. an oil outlet communicating with said outer housing;

b. first and second oil outlet valves respectively controlling oil flows through said oil discharge means and said oil outlet; and c. control means responsive to the oil level in said outer housing for controlling said oil outlet valves.

8. A centrifugal separator according to claim 7 wherein said control means includes means for closing said first and second oil outlet valves in that order in response to a decreasing oil level in said outer housing, and for opening said second and first oil outlet valves in that order in response to an increasing oil level in said outer housing.

9. A centrifugal separator as defined in claim 1 wherein said oil discharge means comprises a pitot tube in said inner rotor chamber.

10. In a centrifugal separator for a mixture of fluids of different densities, the combination of:

a. housing means;

b. a rotor rotatable in said housing means and having an inner rotor chamber and an outer rotor chamber encircling said inner rotor chamber;

c. mixture delivery means for delivering the mixture to said inner rotor chamber;

d. the periphery of said inner rotor chamber having discharge ports communicating with said outer rotor chamber;

e. the periphery of said outer rotor chamber having discharge ports communicating with said housing means;

f. an overflow weir on the outer rotor chamber for discharging excess fluid of greatest density into said housing means;

g. supply means for delivering fluid of the greatest density to said outer rotor chamber at a rate at least equal to the discharge capacity of said discharge ports in said outer rotor chamber at a given rotor speed so as to keep the outer rotor chamber filled to the radius of the weir and maintain a substantially constant pressure in said outer rotor chamber at said given rotor speed; and h. discharge means for removing fluid of a lesser density from said inner rotor chamber under pressure.

11. A centrifugal separator as recited in claim 10 wherein the discharge means for removing fluid of lesser density comprises:

a fixed pitot tube in the inner rotor chamber for removing fluid under pressure; and control means for limiting removal of lesser density fluid via the pitot tube to no more than about the quantity entering the inner rotor chamber.

12. A centrifugal separator as recited in claim 11 wherein the control means for limiting removal of lesser density fluid comprises:

overflow weir means for discharging lesser density fluid into a portion of the housing means;

a valve connected to the pitot tube outlet; and means for controlling the valve in response to level of lesser density fluid in the housing means.

13. A three phase separator for a mixture which may include oil, water, gas and/or solids comprising:

a rotor having a rotor chamber;

means for delivering the mixture to the rotor chamber;

discharge port means on the periphery of the rotor chamber for discharging water and/or solids from the periphery of the rotor chamber;

a first weir means relatively nearer the axis of rotation of the rotor for passage of gas and overflow of excess oil;

a second weir means relatively further from the axis of rotation of the rotor for overflow of excess water;

water passage means between the second weir means and the periphery of the rotor chamber;

means for adding water into the water passage means adjacent the second weir means for keeping the water passage means filled with water during rotation of the rotor for maintaining a constant pressure near the periphery of the rotor corresponding to the head of water in the water passage means between the second weir means and the periphery of the rotor chamber thereby defining a substantially constant oil-water interface radial position in the rotor chamber between the second weir means and the periphery of the rotor chamber;

a stationary pitot tube in the rotor chamber having an inlet in a radial position between the first weir means and the oil-water interface for withdrawing oil under pressure.

14. A three phase separator as recited in claim 13 further comprising:

a housing having an oil compartment for receiving excess oil from the first weir means;

a valve on the outlet from the pitot tube; and means for controlling the valve in response to oil level in the oil compartment.

15. A three phase separator as recited in claim 14 further comprising:

a water compartment in the housing for receiving excess water from the second weir means; and means for selectively discharging water from the water compartment in response to water level in the water compartment; and wherein the means for adding water comprises:

pump means for transferring water from the water compartment to the water passage means adjacent the second weir means.

16. A three phase separator as recited in claim 13 further comprising:

an outer rotor chamber around at least the periphery of the inner rotor chamber, so as to receive water and/or solids discharged through said first mentioned discharge port means;

second discharge port means on the periphery of the outer rotor chamber for discharging water and/or solids from the periphery of the outer rotor chamber; and wherein the water passage means communicates between the second weir means and the outer rotor chamber.

* * * * *